US010883740B2

(12) United States Patent
Naito et al.

(10) Patent No.: US 10,883,740 B2
(45) Date of Patent: Jan. 5, 2021

(54) INDOOR UNIT FOR AN AIR-CONDITIONING APPARATUS

(71) Applicant: Mitsubishi Electric Corporation, Tokyo (JP)

(72) Inventors: Yosuke Naito, Tokyo (JP); Masato Ishikawa, Tokyo (JP); Akimoto Suzuki, Tokyo (JP); Masahide Kinami, Tokyo (JP); Hisanori Ikeda, Tokyo (JP); Takuya Goto, Tokyo (JP); Katsuya Ishigami, Tokyo (JP); Shinji Kawai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 128 days.

(21) Appl. No.: 15/776,423

(22) PCT Filed: Jan. 21, 2016

(86) PCT No.: PCT/JP2016/051651
§ 371 (c)(1),
(2) Date: May 16, 2018

(87) PCT Pub. No.: WO2017/126071
PCT Pub. Date: Jul. 27, 2017

(65) Prior Publication Data

US 2018/0328621 A1 Nov. 15, 2018

(51) Int. Cl.

| | |
|---|---|
| ***F24F 13/20*** | (2006.01) |
| ***F24F 1/0057*** | (2019.01) |
| ***F24F 1/0007*** | (2019.01) |

(52) U.S. Cl.
CPC ..... *F24F 13/20* (2013.01); *F24F 1/0007* (2013.01); *F24F 1/0057* (2019.02)

(58) Field of Classification Search
CPC ..... F24F 13/20; F24F 1/0057; F24F 1/0007
USPC ..... 454/233
See application file for complete search history.

(56) References Cited

U.S. PATENT DOCUMENTS

2015/0300678 A1 10/2015 Niimura et al.

FOREIGN PATENT DOCUMENTS

| | | |
|---|---|---|
| EP | 2 937 642 A1 | 10/2015 |
| JP | H10-132317 A | 5/1998 |
| JP | 2015-206546 A | 11/2015 |

OTHER PUBLICATIONS

Extended European Search Report dated Dec. 12, 2018 issued in corresponding EP patent application No. 16886313.2.

(Continued)

*Primary Examiner* — Edelmira Bosques
*Assistant Examiner* — Dana K Tighe
(74) *Attorney, Agent, or Firm* — Posz Law Group, PLC

(57) ABSTRACT

Provided is an indoor unit for an air-conditioning apparatus capable of preventing crazing, which occurs in a fixing claw or a claw receiver due to intrusion of oil or solvent. The indoor unit for an air-conditioning apparatus includes a rear casing and a front casing. An upper wall is formed, and an overlap portion is formed. The fixing claw is provided, and the claw receiver is provided. The upper wall has a front portion on a front side with respect to the fixing claw, and the claw receiver protrudes rearward from the overlap portion. A recessed portion which is opened upward is formed on a front side of the claw receiver of the overlap portion.

8 Claims, 7 Drawing Sheets

(56) References Cited

OTHER PUBLICATIONS

International Search Report of the International Searching Authority dated Apr. 5, 2016 for the corresponding international application No. PCT/JP2016/051651 (and English translation).

INDOOR UNIT FOR AN AIR-CONDITIONING APPARATUS

CROSS REFERENCE TO RELATED APPLICATION

This application is a U.S. national stage application of PCT/JP2016/051651 filed on Jan. 21, 2016, the contents of which are incorporated herein by reference.

TECHNICAL FIELD

The present invention relates to an indoor unit for an air-conditioning apparatus, which includes a fixing claw and a claw receiver for mounting a front casing to a rear casing.

BACKGROUND ART

In an indoor unit for an air-conditioning apparatus, a fixing claw which protrudes downward from an upper wall of a rear casing is locked to a claw receiver which protrudes from the front casing. The fixing claw is locked to the claw receiver as describe above so that the front casing is mounted to the rear casing.

In Patent Literature 1, there is disclosed a technology which involves use of the fixing claw and the claw receiver to mount the front casing to the rear casing.

CITATION LIST

Patent Literature

Patent Literature 1: Japanese Unexamined Patent Application Publication No. 10-132317

SUMMARY OF INVENTION

Technical Problem

An indoor unit for an air-conditioning apparatus is a mass-produced product. Therefore, a mold for manufacturing the indoor unit for an air-conditioning apparatus is worn away. Further, in manufacturing the indoor unit for an air-conditioning apparatus, assembly is performed by hand.

Therefore, at a joint portion of an upper end of the rear casing and an upper end of the front casing, there is molding variation or assembly variation, and hence a gap is liable to be formed. It is difficult to completely prevent the gap from being formed.

The indoor unit for an air-conditioning apparatus may be installed, for example, in a room near a kitchen or a room where oil or solvent is used. In such case, the oil or the solvent which has been scattered in an indoor space may intrude into the indoor unit for an air-conditioning apparatus through the gap formed at the joint portion of the upper end of the rear casing and the upper end of the front casing.

In some cases, the oil or the solvent which has intruded may reach the fixing claw and the claw receiver for locking the rear casing and the front casing to each other.

The rear casing and the front casing are components which are made of amorphous plastic. When the oil or the solvent adheres to part of such plastic to which stress is applied, the amorphous plastic is broken with stress significantly smaller than a break strength that the plastic itself exhibits. In this description, such breakage phenomenon is hereinafter referred to as crazing.

The fixing claw and the claw receiver receive stress caused by supporting the front casing. Thus, the crazing may occur in the fixing claw or the claw receiver due to intrusion of the oil or the solvent. When the crazing occurs in the fixing claw or the claw receiver, there is a fear in that the front casing comes off of the rear casing.

The present invention has been made to solve the above-mentioned problem, and has an object to provide an indoor unit for an air-conditioning apparatus, which is capable of preventing crazing in a fixing claw or a claw receiver intrusion of oil or solvent.

Solution to Problem

According to one embodiment of the present invention, there is provided an indoor unit for an air-conditioning apparatus, including: a rear casing for mounting a heat exchanger and an air-sending fan on a front side of the rear casing; and a front casing for surrounding the heat exchanger and the air-sending fan on the front side of the rear casing. The rear casing has an upper wall, which is formed at an upper portion of the rear casing and protrudes frontward. The front casing has an overlap portion, which is formed at an upper portion of the front casing and protrudes rearward to be overlapped by the upper wall. The upper wall of the rear casing has a fixing claw, which protrudes downward from a lower surface of the upper wall. The front casing has a claw receiver for locking the fixing claw from a lower side of the fixing claw. The upper wall has a front portion on a front side with respect to the fixing claw. The claw receiver protrudes rearward from the overlap portion. The overlap portion has a recessed portion, which is opened upward on a front side of the claw receiver.

Advantageous Effects of Invention

According to the indoor unit for an air-conditioning apparatus of one embodiment of the present invention, the recessed portion which is opened upward is formed on the front side of the claw receiver of the overlap portion. In this manner, at the joint portion of the upper end of the rear casing and the upper end of the front casing, the gap is formed due to molding variation or assembly variation. Thus, the oil or the solvent adheres to the recessed portion to be stored therein even when the oil or the solvent intrudes through the gap. Therefore, the oil or the solvent which has intruded does not reach the fixing claw and the claw receiver to which the stress is applied. Therefore, the crazing in the fixing claw or the claw receiver due to intrusion of the oil or the solvent can be prevented.

As a result, there is no need to consider the influence of the crazing in the fixing claw or the claw receiver. The indoor unit for an air-conditioning apparatus may be installed, for example, in a room near a kitchen or a room where the oil or the solvent is used, and hence there is no need to consider the installation place therefore.

DESCRIPTION OF EMBODIMENTS

Now, an embodiment of the present invention is described with reference to the drawings.

In each of the drawings, components denoted by the same reference symbols correspond to the same or equivalent components. This is common throughout the description herein.

In addition, the modes of the components described herein are merely examples, and the components are not limited to the description herein.

Embodiment

Figure 1:
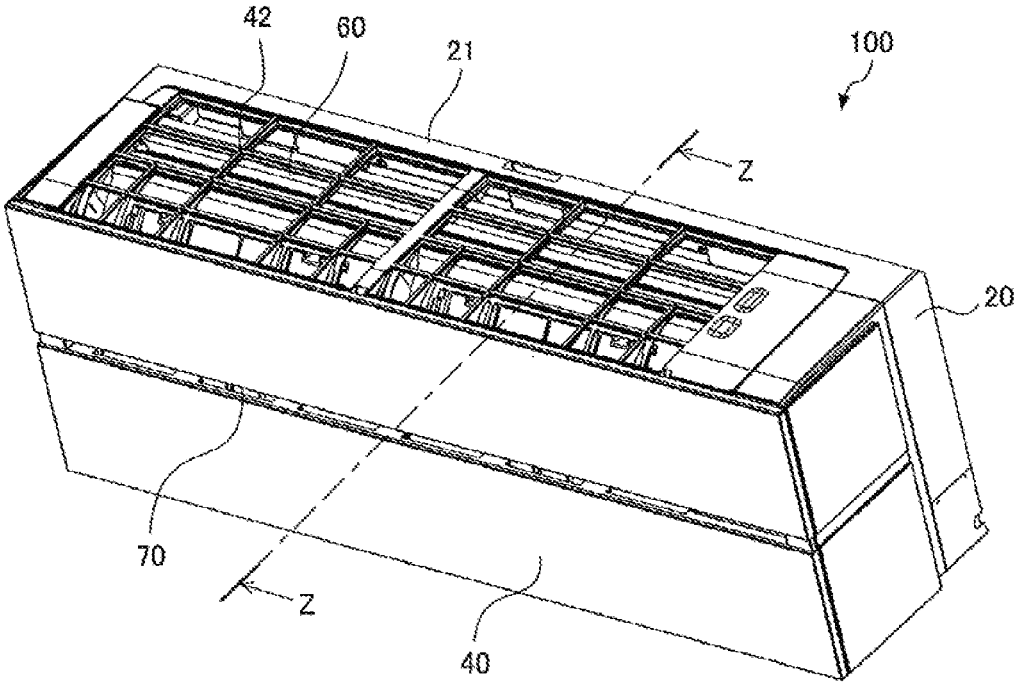
FIG. 1 is a perspective view for illustrating an indoor unit for an air-conditioning apparatus according to an embodiment of the present invention.
Figure 2:
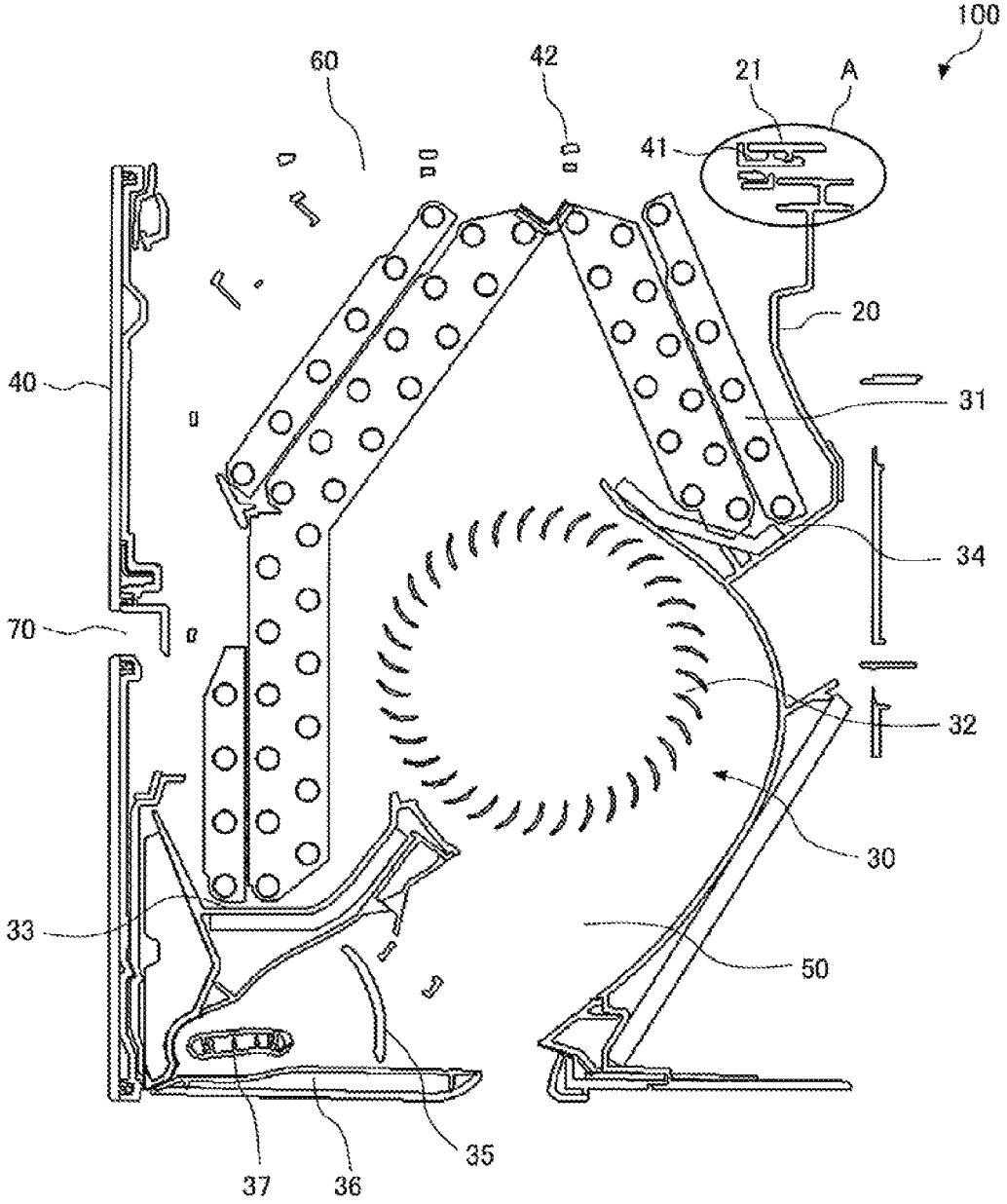
FIG. 2 is an explanatory view for illustrating the indoor unit for an air-conditioning apparatus according to the embodiment of the present invention, and is an illustration of a cross section taken along the line Z-Z of FIG. 1.
Figure 3:
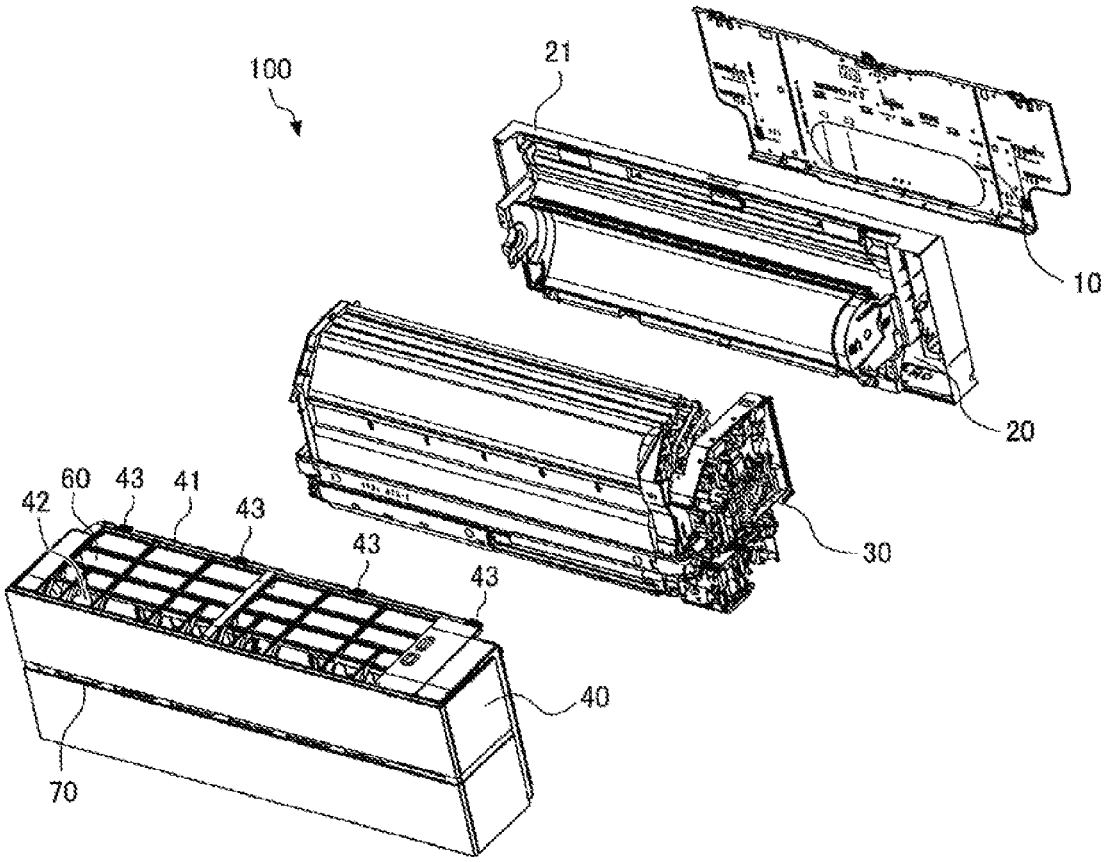
FIG. 3 is an exploded perspective view for illustrating an entirety of the indoor unit for an air-conditioning apparatus according to the embodiment of the present invention.

FIG. 1 is a perspective view for illustrating an indoor unit 100 for an air-conditioning apparatus according to an embodiment of the present invention. FIG. 2 is an explanatory view for illustrating the indoor unit 100 for an air-conditioning apparatus according to the embodiment of the present invention, and is an illustration of a cross section taken along the line Z-Z of FIG. 1. FIG. 3 is an exploded perspective view for illustrating an entirety of the indoor unit 100 for an air-conditioning apparatus according to the embodiment of the present invention.

The indoor unit 100 for an air-conditioning apparatus is a wall-hung type indoor unit including a compressor, a four-way valve, a condensation-side heat exchanger, a pressure reducing device, and an evaporation-side heat exchanger, which are connected to one another. The compressor is driven by an inverter, and thus a rotation speed thereof is capable of being controlled. Through switching of the four-way valve, a cooling operation and a heating operation can be achieved.

As illustrated in FIG. 1 to FIG. 3, the indoor unit 100 for an air-conditioning apparatus includes a back plate 10, a rear casing 20 fixed to the back plate 10, internal components 30 mounted to the rear casing 20, and a front casing 40 constructing a decorative surface of the indoor unit 100.

The rear casing 20 and the front casing 40 are components which are made of amorphous plastic.

The internal components 30 are mounted to the rear casing 20. The internal components 30 include a heat exchanger 31 having a convexly curved shape, an air-sending fan 32 which is positioned downstream of an airflow with respect to the heat exchanger 31, and an electric component box (not shown). A drain pan 33 for receiving dew condensation water from the heat exchanger 31 is formed at a front lower portion of the heat exchanger 31. A drain pan 34 for receiving the dew condensation water from the heat exchanger 31 is formed at a rear lower portion of the heat exchanger 31. An air outlet 50 for blowing out air having been subjected to heat exchange is formed below the air-sending fan 32.

The front casing 40 constructs an upper surface portion, right and left surface portions, and a front surface portion of the indoor unit 100 for an air-conditioning apparatus. The front casing 40 accommodates and surrounds the internal components 30 on a front side of the rear casing 20. Upper air inlets 60 are formed in the upper surface of the front casing 40. A front air inlet 70 is formed in the front surface of the front casing 40. The front casing 40 is fixed to the rear casing 20. A method of fixing the front casing 40 is described later.

The indoor unit 100 for an air-conditioning apparatus includes a first up-and-down wind direction plate 35, a second up-and-down wind direction plate 36, and a third up-and-down wind direction plate 37, which are positioned in the air outlet 50 and are configured to adjust a direction of wind blowing out through the air outlet 50 in an up-and-down direction being a height direction of a living space.

The first up-and-down wind direction plate 35 is formed of a curved plate-like member. The first up-and-down wind direction plate 35 is positioned between the second up-and-down wind direction plate 36 and the third up-and-down wind direction plate 37 during operation. The second up-and-down wind direction plate 36 is positioned at a rear portion of the air outlet 50. The third up-and-down wind direction plate 37 is positioned at a front portion of the air outlet 50. The third up-and-down wind direction plate 37 has a size smaller than that of the second up-and-down wind direction plate 36. The first up-and-down wind direction plate 35, the second up-and-down wind direction plate 36, and the third up-and-down wind direction plate 37 can be rotated by a driving motor (not shown).

The indoor unit 100 for an air-conditioning apparatus sucks an indoor air through the upper air inlets 60 and the front air inlet 70 with the air-sending fan 32. The sucked air is subjected to heat exchange at the heat exchanger 31 to turn into a cold air or a warm air. The cold air or the warm air is sent to an indoor space through the air outlet 50 in which a right-and-left wind direction plate (not shown), the first up-and-down wind direction plate 35, the second up-and-down wind direction plate 36, and the third up-and-down wind direction plate 37 are positioned.

At this time, the right-and left wind direction plate is rotated to adjust a right-and-left wind direction of the air having been subjected to heat exchange and blown out by the air-sending fan 32. Further, the first up-and-down wind direction plate 35, the second up-and-down wind direction plate 36, and the third up-and-down wind direction plate 37 are rotated to adjust the up-and-down wind direction of the air having been subjected to heat exchange and blown out by the air-sending fan 32.

Now, description is made of a configuration in which a transverse fan is provided downstream of the heat exchanger 31 as the air-sending fan 32. However, as the air-sending fan, a fan other than the transverse fan, for example, a propeller fan may be included. Further, there may be employed a configuration in which a fan other than the transverse fan, for example, a propeller fan is provided upstream of the heat exchanger 31 as the air-sending fan.

Next, a method of fixing the indoor unit 100 for an air-conditioning apparatus is described.

The back plate 10 illustrated in FIG. 3 is fixed to an indoor wall surface with a plurality of screws. A locking body (not shown) protrudes at an upper end of the back plate 10.

An upper edge of the rear casing 20 is hooked to the locking body of the back plate 10. After the upper edge of the rear casing 20 is hooked to the locking body, the rear casing 20 is fixed to the back plate 10 with a plurality of screws (not shown).

The internal components 30 include the heat exchanger 31, the air-sending fan 32, and the electric component box, and are fixed to a front side of the rear casing 20 fixed to the back plate 10.

Further, description is made of the method of fixing the front casing 40 to the rear casing 20.

Figure 4:
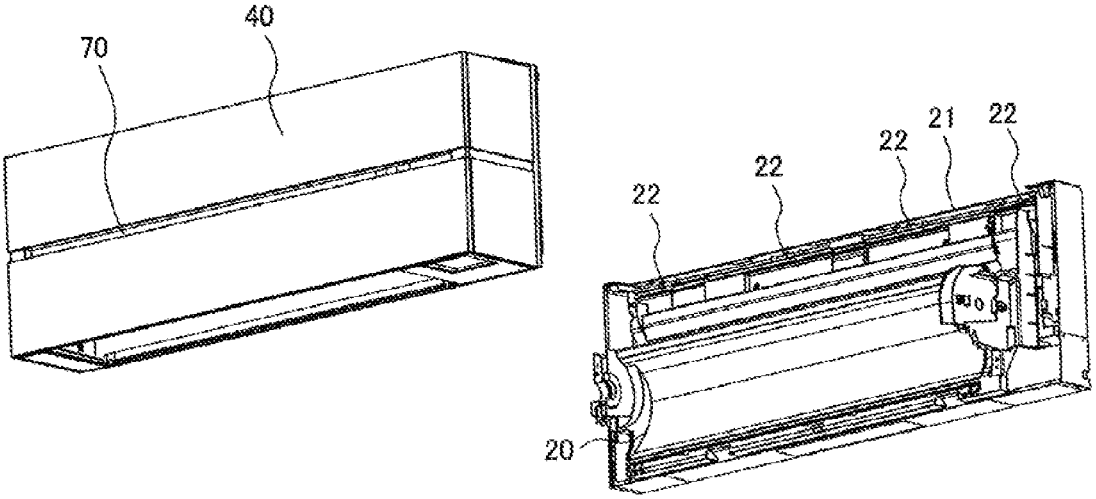
FIG. 4 is a perspective view for illustrating a rear casing and a front casing in the embodiment of the present invention.
Figure 5:
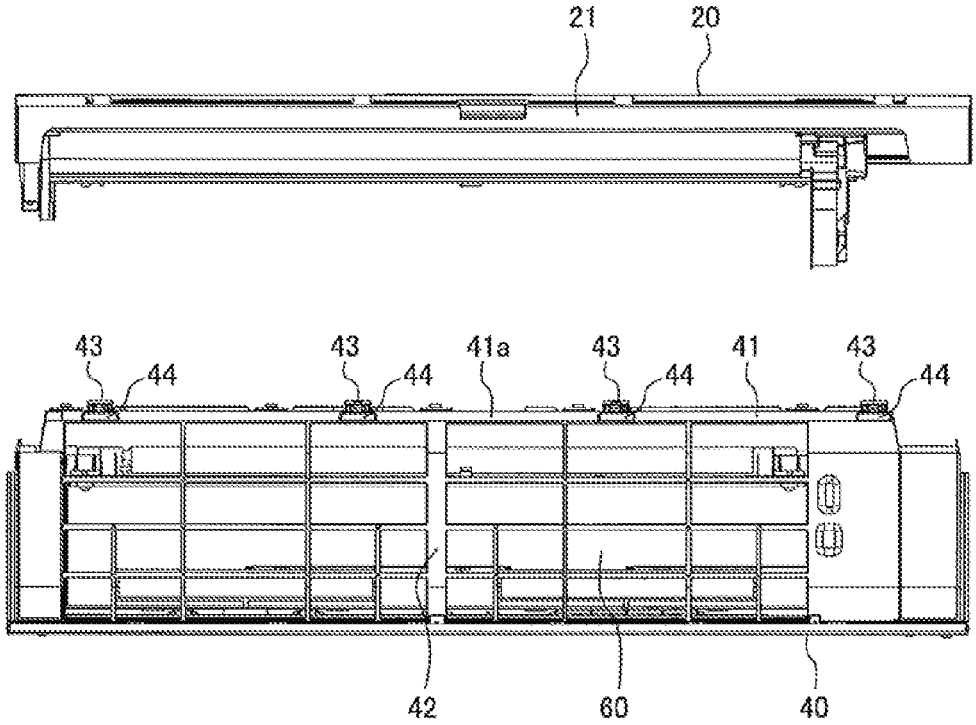
FIG. 5 is a top view for illustrating the rear casing and the front casing of the embodiment of the present invention.
Figure 6:
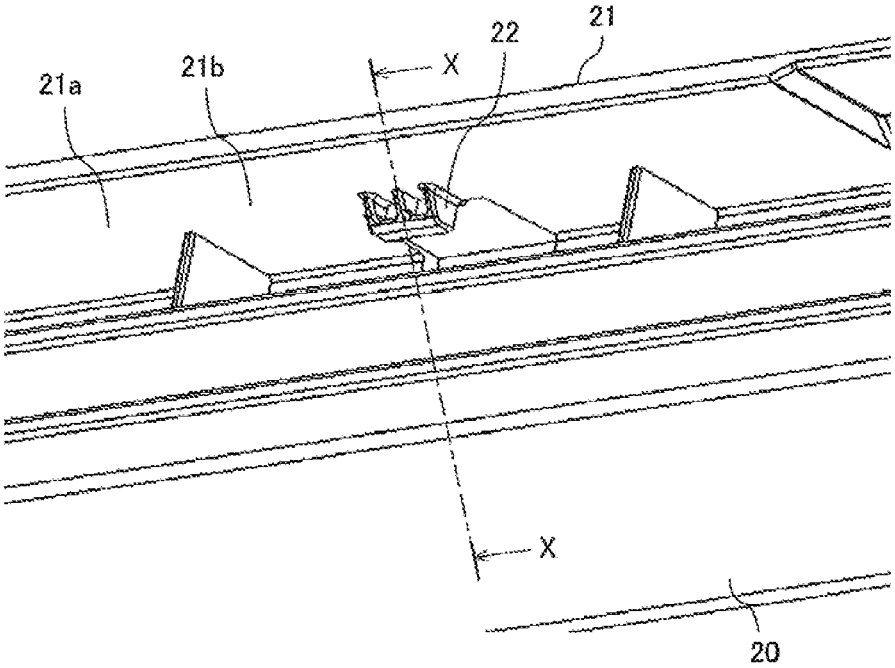
FIG. 6 is a perspective view for illustrating a fixing claw of the rear casing in the embodiment of the present invention.
Figure 7:
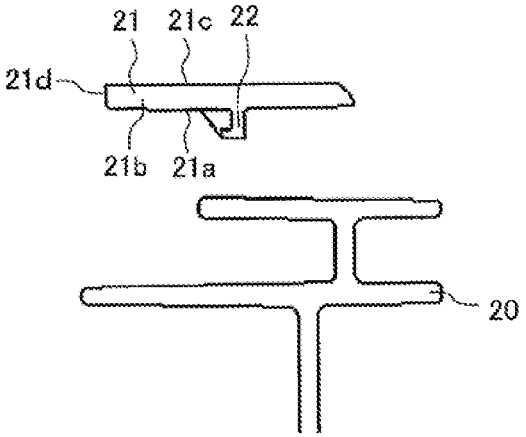
FIG. 7 is an explanatory view for illustrating the fixing claw of the rear casing in the embodiment of the present invention, and is an illustration of a cross section taken along the line X-X of FIG. 6.
Figure 8:
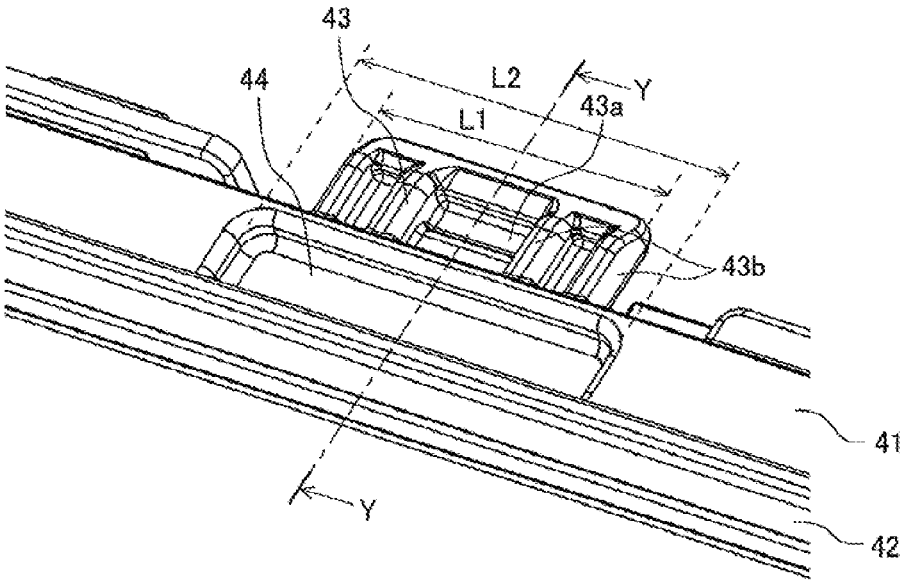
FIG. 8 is a perspective view for illustrating a claw receiver of the front casing in the embodiment of the present invention.
Figure 9:
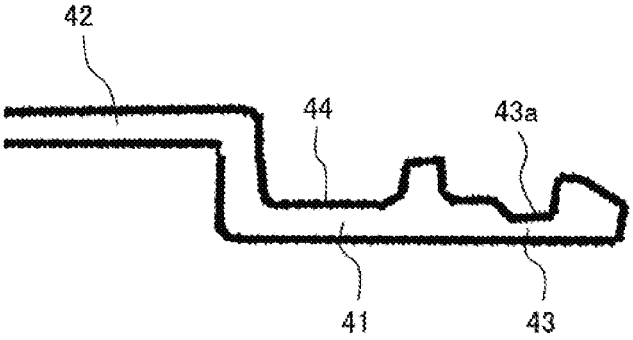
FIG. 9 is an explanatory view for illustrating the claw receiver of the front casing in the embodiment of the present invention, and is an illustration of a cross section taken along the line Y-Y of FIG. 8.
Figure 10:
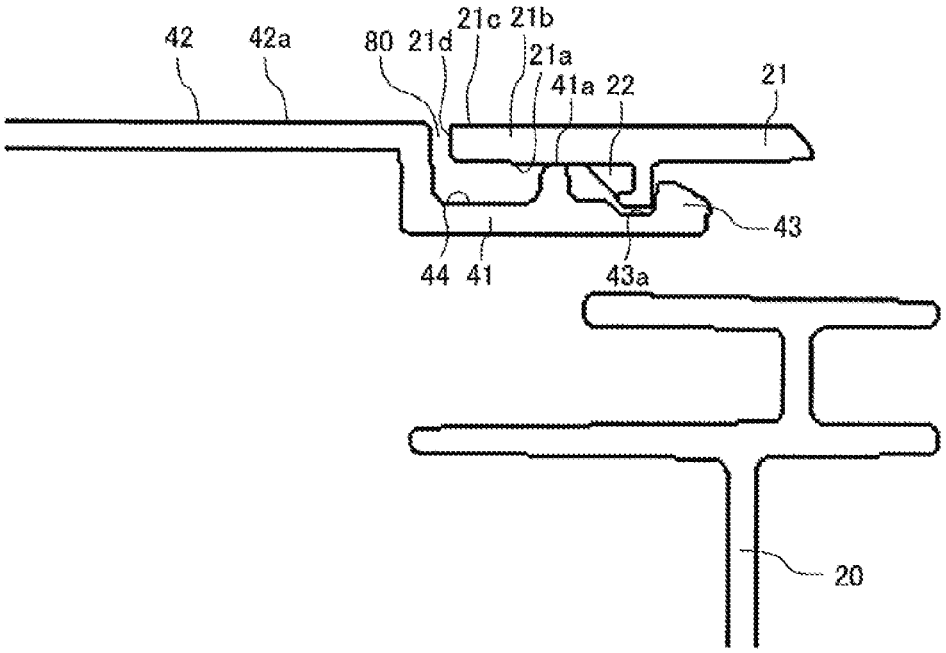
FIG. 10 is an enlarged explanatory view of the portion A of FIG. 2, and is an illustration of the cross section of a state in which the fixing claw is locked to the claw receiver in the embodiment of the present invention.

FIG. 4 is a perspective view for illustrating the rear casing 20 and the front casing 40 in the embodiment of the present invention. FIG. 5 is a top view for illustrating the rear casing 20 and the front casing 40 in the embodiment of the present invention. FIG. 6 is a perspective view for illustrating a fixing claw 22 of the rear casing 20 in the embodiment of the present invention. FIG. 7 is an explanatory view for illustrating the fixing claw 22 of the rear casing 20 in the embodiment of the present invention, and is an illustration of a cross section taken along the line X-X of FIG. 6. FIG. 8 is a perspective view for illustrating a claw receiver 43 of the front casing 40 in the embodiment of the present invention. FIG. 9 is an explanatory view for illustrating the claw receiver 43 of the front casing 40 in the embodiment of the present invention, and is an illustration of a cross section taken along the line Y-Y of FIG. 8. FIG. 10 is an enlarged explanatory view of the portion A of FIG. 2, and is an illustration of the cross section of a state in which the fixing claw 22 is locked to the claw receiver 43 in the embodiment of the present invention.

As illustrated in FIG. 4 and FIG. 5, an upper wall 21, which horizontally protrudes frontward, is formed at an upper portion of the rear casing 20. The upper wall 21 is formed over an entirety between a right end portion and a left end portion of the indoor unit 100 for an air-conditioning apparatus.

As illustrated in FIG. 6 and FIG. 7, a plurality of fixing claws 22, which protrude downward from a lower surface 21*a* of the upper wall 21, are provided to the upper wall 21 of the rear casing 20. A front side of the fixing claw 22 is inclined so that an upper portion of the fixing claw 22 extends frontward with respect to a lower portion of the fixing claw 22.

The fixing claw 22 is positioned on the rear side with respect to a front edge portion of the upper wall 21. That is, the upper wall 21 of the rear casing 20 has a front portion 21*b* on the front side with respect to the fixing claw 22.

As illustrated in FIG. 5 and FIG. 8, an overlap portion 41, which horizontally protrudes rearward and is overlapped by the upper wall 21, is formed at the upper portion of the front casing 40. The overlap portion 41 is formed over the entirety between the right end portion and the left end portion of the indoor unit 100 for an air-conditioning apparatus.

The front casing 40 has a top design panel 42 in which the upper air inlets 60 are formed on the front side with respect to the overlap portion 41. The overlap portion 41 is formed to be lower than the top design panel 42 in a stepped manner by a thickness of the upper wall 21.

As illustrated in FIG. 5, FIG. 8, and FIG. 9, a plurality of claw receivers 43 for locking the fixing claws 22 from below the fixing claws 22 are provided to the front casing 40. The claw receiver 43 horizontally protrudes rearward from the overlap portion 41. The claw receiver 43 includes an accommodating recessed portion 43*a* for accommodating the fixing claw 22 at the center of the claw receiver 43, and ribs 43*b* for reinforcement on both right and left sides of the accommodating recessed portion 43*a*. A rear end of the claw receiver 43 is tapered so as to guide the fixing claw 22 when the claw receiver 43 is brought into contact with the fixing claw 22.

When the front casing 40 is mounted to the rear casing 20, the fixing claws 22 are locked to the claw receivers 43. At the start of mounting the front casing 40, the front casing 40 is horizontally moved to the rear casing 20 side. The horizontal movement is continuously performed until the overlap portion 41 of the front casing 40 is overlapped by the upper wall 21 of the rear casing 20. When the front casing 40 is horizontally moved as described above, the internal components 30 mounted to the rear casing 20 can be accommodated in the front casing 40.

As illustrated in FIG. 10, when the overlap portion 41 of the front casing 40 is overlapped by the upper wall 21 of the rear casing 20, the claw receiver 43 enters an inside of the rear casing 20 so that the fixing claw 22 is locked to the claw receiver 43. The plurality of fixing claws 22 and the plurality of claw receivers 43 are provided, and hence stress caused by supporting the front casing 40 is dispersed.

When the fixing claw 22 is locked to the claw receiver 43, the upper surface 21*c* of the upper wall 21 and the upper surface 42*a* of the top design panel 42 are flush with each other.

In this case, when the front casing 40 is removed from the rear casing 20, the lower portion of the front casing 40 is pivoted about a locking portion of the fixing claw 22 and the claw receiver 43 as a fulcrum. In this manner, the claw receiver 43 of the front casing 40 comes off of the fixing claw 22. After that, the front casing 40 is separated so as to be horizontally dragged.

That is, according to the embodiment, through horizontal back and forth movement of the front casing 40 with respect to the rear casing 20, the rear casing 20 and the front casing 40 can be coupled to or separated from each other.

A recessed portion 44 formed in the overlap portion 41 is described.

As illustrated in FIG. 5, FIG. 8, FIG. 9, and FIG. 10, on the front side of the claw receiver 43 of the overlap portion 41, the recessed portion 44 which is opened upward is formed. The recessed portion 44 has a rectangular opening shape. The recessed portion 44 is entirely surrounded by the overlap portion 41. The recessed portion 44 has an internal capacity large enough to store ten years' worth of oil or a solvent, that is, for a lifetime of the indoor unit 100 for an air-conditioning apparatus.

As illustrated in FIG. 8, the recessed portion 44 has a right-and-left width L2 larger than a right-and-left width L1 of the claw receiver 43. That is, a center of the recessed portion 44 in the right-and-left direction matches with a center of the claw receiver 43 in the right-and-left direction and a center line of the claw receiver 43, which extends in a front-and-rear direction. In FIG. 8, the dashed-dotted line for the cross section Y-Y corresponds to the center line. Further, the right-and-left width L2 of the recessed portion 44 is larger than the right-and-left width L1 of the claw receiver 43, and extends on the front side of the entire right-and-left width of the claw receiver 43.

As illustrated in FIG. 2 and FIG. 10, the recessed portion 44 has such front-and-rear width that the recessed portion 44 passes a front end edge 21*d* of the upper wall 21 in the front-and-rear direction when the fixing claw 22 is locked to the claw receiver 43. This is because there is formed, due to molding variation or assembly variation, a gap 80 at a joint portion of the upper end of the rear casing 20 and the upper end of the front casing 40.

In this case, in the overlap portion 41, an upper surface 41*a* except for the recessed portion 44 is a horizontal surface. Thus, when the fixing claw 22 is locked to the claw receiver 43, the overlap portion 41 is overlapped by the upper wall 21 while the upper surface 41*a* including the periphery of the recessed portion 44 is brought into contact with the lower surface 21*a* of the upper wall 21. Accordingly, between the recessed portion 44 and the claw receiver 43, the upper surface 41*a*, which is an edge portion of the overlap portion 41 held in contact with the lower surface 21*a* of the upper wall 21, is present, and hence the upper wall 21 and the overlap portion 41 are closely contact with each other.

With the above-mentioned structure, due to the molding variation or the assembly variation, the gap 80 is formed at the joint portion of the upper end of the rear casing 20 and the upper end of the front casing 40. The oil or the solvent intrudes into the indoor unit 100 for an air-conditioning apparatus through the gap 80. However, the oil or the solvent which has intruded adheres to the recessed portion 44 to be stored therein. Further, between the recessed portion 44 and the claw receiver 43, the upper surface 41*a* of the overlap portion 41, which is held in contact with the lower surface 21*a* of the upper wall 21, is present, and hence the upper wall 21 and the overlap portion 41 are closely contact with each other. Thus, the oil or the solvent stored in the recessed portion 44 does not intrude from the recessed portion 44 into the claw receiver 43 side any further. With this structure, the oil or the solvent which has intruded does not reach the claw receiver 43 to which the stress caused by supporting the front casing 40 is applied. Accordingly, crazing which may occur in the claw receiver 43 due to intrusion of the oil or the solvent can be prevented.

Therefore, when the indoor unit 100 for an air-conditioning apparatus is installed, there is no need to consider the influence of the crazing in the claw receiver 43. The indoor unit 100 for an air-conditioning apparatus may be installed, for example, in a room near a kitchen, or a room where the oil or the solvent is used, and hence there is no need to consider the installation place therefore. As described above, according to the embodiment, the reliable indoor unit 100 for an air-conditioning apparatus can be obtained.

Further, in the front casing 40, the recessed portion 44 is formed in the overlap portion 41 which is formed over the entirety between the right end portion and the left end portion of the indoor unit 100 for an air-conditioning apparatus, and the stress is not applied to the recessed portion 44 itself. Thus, even when the oil or the solvent adheres to the recessed portion 44 to be stored therein, the crazing in the recessed portion 44 does not occur.

In the above, the present invention is described based on the embodiment. However, the present invention is not limited thereto.

For example, the recessed portion 44 may be formed only at a root of the claw receiver 43 as long as the recessed portion 44 does not protrude from the overlap portion 41. However, the recessed portion is required to have the internal capacity large enough to store the ten years' worth of the oil or the solvent, that is, for the lifetime of the indoor unit 100 for an air-conditioning apparatus can be secured.

Further, the shapes of the fixing claw 22 and the claw receiver 43 are not limited to the embodiment described above.

According to the embodiment described above, the indoor unit 100 for an air-conditioning apparatus includes the rear casing 20, to which the heat exchanger 31 and the air-sending fan 32 are mounted on its front side, and the front casing 40 for surrounding the front side of the rear casing 20. At the upper portion of the rear casing 20, the upper wall 21 which protrudes frontward is formed. At the upper portion of the front casing 40, the overlap portion 41, which protrudes rearward and is overlapped by the upper wall 21, is formed. The fixing claws 22, which protrude downward from the lower surface 21*a*, are provided to the upper wall 21 of the rear casing 20. The claw receivers 43 for locking the fixing claws 22 from the lower portions of the fixing claws 22, are provided to the front casing 40. The upper wall 21 has the front portion 21*b* which is present on the front side with respect to the fixing claws 22. The claw receivers 43 protrude rearward from the overlap portion 41. In the overlap portion 41, the recessed portion 44 which is opened upward is formed on the front side of the claw receiver 43.

With this structure, on the front side of the claw receiver 43 in the overlap portion 41, the recessed portion 44 which is opened upward is formed. With this portion, the oil or the solvent adheres to the recessed portion 44 to be stored therein even when the gap 80 is formed at the joint portion of the upper end of the rear casing 20 and the upper end of the front casing 40 due to the molding variation or the assembly variation so that the oil or the solvent intrudes through the gap 80. Thus, the oil or the solvent which has intruded does not reach the claw receiver 43 to which the stress is applied. As a result, the crazing which may occur in the claw receiver 43 due to the oil or the solvent which has intruded can be prevented.

Accordingly, there is no need to consider the influence of the crazing which may occur in the claw receiver 43. The indoor unit 100 for an air-conditioning apparatus may be installed, for example, in a room near a kitchen, or a room where the oil or the solvent is used, and hence there is no need to consider the installation place therefore.

The recessed portion 44 has such front-and-rear width that the recessed portion 44 passes the front end edge 21*d* of the upper wall 21 in the front-and-rear direction when the fixing claw 22 is locked to the claw receiver 43.

With this structure, due to the molding variation or the assembly variation, the gap 80 is formed at the joint portion of the upper end of the rear casing 20 and the upper end of the front casing 40, and hence the recessed portion 44 is opened toward the gap 80. Thus, when the oil or the solvent intrudes through the gap 80, the oil or the solvent which has intruded immediately adheres to the recessed portion 44 to be stored therein.

The recessed portion 44 has the right-and-left width L2 larger than the right-and-left width L1 of the claw receiver 43.

With this structure, on the front side of the claw receiver 43, in which the gap 80, through which the oil or the solvent intrudes, is present, the recessed portion 44 is formed in a range wider than that of the claw receiver 43. Thus, the oil or the solvent which has intruded through the gap 80 cannot avoid the recessed portion 44 and reach the claw receiver 43.

Accordingly, the oil or the solvent which has intruded is reliably prevented from reaching the claw receiver 43 to which the stress is applied.

When the fixing claws 22 are locked to the claw receivers 43, the overlap portion 41 is overlapped by the upper wall 21 while the upper surface 41*a* is held into contact with the lower surface 21*a* of the upper wall 21.

With this structure, the oil or the solvent which has intruded through the gap 80 intrudes only into the recessed portion 44 because the lower surface 21*a* of the upper wall 21 and the upper surface 41*a* of the overlap portion 41 are held in contact with each other. Thus, the oil or the solvent which has intruded is reliably prevented from reaching the claw receiver 43 to which the stress is applied.

The upper wall 21 and the overlap portion 41 are formed over the entirety between the right end portion and the left end portion of the indoor unit 100 for an air-conditioning apparatus.

With this structure, the oil or the solvent which has intruded though the gap 80 can be prevented from reaching the portions other than the recessed portion 44 along the entire width between the right end portion and the left end portion of the indoor unit 100 for an air-conditioning apparatus.

The rear casing 20 and the front casing 40 are made of amorphous plastic.

When the oil or the solvent adheres to part of amorphous plastic, to which stress is applied, the crazing is caused, that is, the amorphous plastic is broken with stress significantly smaller than a break strength that the plastic itself exhibits. However, with the structure describe above, the oil or the solvent which has intruded through the gap 80 does not reach the claw receiver 43 to which the stress is applied. Therefore, the crazing caused by the oil or the solvent which has intruded is prevented from occurring in the claw receiver 43.

The plurality of fixing claws 22 and the plurality of claw receivers 43 are provided so that the stress received from the front casing 40 is dispersed.

With this structure, the plurality of fixing claws 22 and the plurality of claw receivers 43 to which the stress is applied are provided, and hence the stress which is applied to each of the fixing claws 22 and each of the claw receivers 43 can be reduced.

The front casing 40 has the top design panel 42 on the front side with respect to the overlap portion 41. The overlap portion 41 is formed to be lower than the top design panel 42 by the thickness of the upper wall 21. When the fixing claws 22 are locked to the claw receivers 43, the upper surface 21*c* of the upper wall 21 and the upper surface 42*a* of the top design panel 42 are flush with each other.

With this structure, even when the gap 80 is formed at the joint portion of the upper end of the rear casing 20 and the upper end of the front casing 40 due to the molding variation or the assembly variation, the gap 80 is not liable to be increased. Thus, the oil or the solvent is not liable to intrude into the indoor unit 100 for an air-conditioning apparatus.

Further, there is no unnecessary irregularities on the upper surface of the indoor unit 100 for an air-conditioning apparatus, and hence the design property is enhanced.

| Reference Signs List |
|---|
| 10 back plate |
| 20 rear casing |
| 21 upper wall |

-continued

| Reference Signs List |
|---|
| 21a lower surface |
| 21b front portion |
| 21c upper surface |
| 21d front end edge |
| 22 fixing claw |
| 30 internal component |
| 31 heat exchanger |
| 32 air-sending fan |
| 33 drain pan |
| 34 drain pan |
| 35 first up-and-down wind direction plate |
| 36 second up-and-down wind direction plate |
| 37 third up-and-down wind direction plate |
| 40 front casing |
| 41 overlap portion |
| 41a upper surface |
| 42 top design panel |
| 42a upper surface |
| 43 claw receiver |
| 43a accommodating recessed portion |
| 43b rib |
| 44 recessed portion |
| 50 air outlet |
| 60 upper air inlet |
| 70 front air inlet |
| 80 gap |
| 100 indoor unit |

The invention claimed is:

1. An indoor unit for an air-conditioning apparatus, comprising:

a rear casing for mounting a heat exchanger and an air-sending fan on a front side of the rear casing; and a front casing for surrounding the heat exchanger and the air-sending fan on the front side of the rear casing, wherein the rear casing has an upper wall, which is formed at an upper portion of the rear casing and protrudes frontward, wherein the front casing has an overlap portion, which is formed at an upper portion of the front casing and protrudes rearward to be overlapped by the upper wall, wherein the upper wall of the rear casing has a fixing claw, which protrudes downward from a lower surface of the upper wall, wherein the front casing has a claw receiver for locking the fixing claw from a lower side of the fixing claw, wherein the upper wall has a front portion on a front side with respect to the fixing claw, wherein the claw receiver protrudes rearward from the overlap portion, wherein the overlap portion has a recessed portion, which is entirely surrounded by the overlap portion and opened upward on a front side of the claw receiver, and wherein the overlap portion has a side provided between the recessed portion and the claw receiver.

2. The indoor unit for the air-conditioning apparatus of claim 1, wherein, when the fixing claw is locked to the claw receiver, the recessed portion has such front-and-rear width that the recessed portion passes a front end edge of the upper wall in a front-and-rear direction of the indoor unit.

3. The indoor unit for the air-conditioning apparatus of claim 1, wherein the recessed portion has a right-and-left width larger than a right-and-left width of the claw receiver.

4. The indoor unit for the air-conditioning apparatus of claim 1, wherein, when the fixing claw is locked to the claw receiver, an upper surface of the overlap portion is overlapped by the upper wall while the overlap portion is in contact with the lower surface of the upper wall.

5. The indoor unit for the air-conditioning apparatus of claim 1, wherein the upper wall and the overlap portion are formed over an entirety between a right end portion and a left end portion of the indoor unit.

6. The indoor unit for the air-conditioning apparatus of claim 1, wherein the rear casing and the front casing are made of amorphous plastic.

7. The indoor unit for the air-conditioning apparatus of claim 1, wherein the fixing claw and the claw receiver comprise a plurality of fixing claws and a plurality of claw receivers, respectively, so as to disperse stress which is received from the front casing.

8. The indoor unit for the air-conditioning apparatus of claim 1, wherein the front casing has a top design panel on a front side with respect to the overlap portion, wherein the overlap portion is formed to be lower than the top design panel by a thickness of the upper wall, and wherein, when the fixing claw is locked to the claw receiver, an upper surface of the upper wall and an upper surface of the top design panel are flush with each other.

* * * * *